US008145112B2

(12) United States Patent
Baba

(10) Patent No.: US 8,145,112 B2
(45) **Date of Patent: *Mar. 27, 2012**

(54) HEATING ROTATING BODY, HEATING DEVICE, FIXING DEVICE AND IMAGE FORMING DEVICE

(75) Inventor: Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 655 days.

This patent is subject to a terminal disclaimer.

(21) Appl. No.: 12/333,989

(22) Filed: Dec. 12, 2008

(65) Prior Publication Data

US 2009/0290915 A1 Nov. 26, 2009

(30) Foreign Application Priority Data

May 23, 2008 (JP) ..... 2008-136077

(51) Int. Cl.
*G03G 15/20* (2006.01)

(52) U.S. Cl. ..... 399/329; 399/69

(58) Field of Classification Search ..... 399/69, 399/329, 333

See application file for complete search history.

(56) References Cited

U.S. PATENT DOCUMENTS

| | | | | |
|---|---|---|---|---|
| 6,978,110 | B2 | 12/2005 | Nakayama et al. | |
| 7,079,801 | B2 | 7/2006 | Nakayama | |
| 7,212,775 | B2 | 5/2007 | Kachi | |
| 2002/0190060 | A1* | 12/2002 | Imai et al. | 219/619 |
| 2003/0095818 | A1 | 5/2003 | Nakayama | |
| 2005/0244199 | A1 | 11/2005 | Nakayama | |
| 2008/0124147 | A1 | 5/2008 | Uchara et al. | |
| 2008/0205948 | A1 | 8/2008 | Baba et al. | |
| 2008/0226326 | A1 | 9/2008 | Seo et al. | |
| 2009/0232534 | A1 | 9/2009 | Hasoba et al. | |
| 2009/0263168 | A1* | 10/2009 | Baba | 399/329 |

FOREIGN PATENT DOCUMENTS

| | | |
|---|---|---|
| EP | 0632344 | 1/1995 |
| JP | 06-348154 | 12/1994 |
| JP | 11-288190 | 10/1999 |
| JP | 2000-030850 | 1/2000 |
| JP | 2000-335804 | 12/2000 |
| JP | 2003-186322 | 7/2003 |
| JP | 2003-330291 A | 11/2003 |
| JP | 3527442 B | 2/2004 |
| JP | 2005-183122 | 7/2005 |
| JP | 2005-203273 | 7/2005 |
| JP | 2006-119510 | 5/2006 |
| JP | 3901414 | 1/2007 |
| JP | 3931589 | 3/2007 |
| JP | 2007-242635 A | 9/2007 |
| WO | WO 2006/009825 A1 | 1/2006 |
| WO | WO 2006/098275 A1 | 9/2006 |

* cited by examiner

*Primary Examiner* — David Gray
*Assistant Examiner* — Joseph S Wong
(74) *Attorney, Agent, or Firm* — Morgan, Lewis & Bockius LLP

(57) ABSTRACT

A heating rotating body includes: a rotating body that generates heat due to electromagnetic induction in a magnetic field and whose magnetic permeability starts to decrease continuously from a magnetic permeability change start temperature that is in a temperature region that is greater than or equal to a set temperature and less than or equal to a heat-resistant temperature, and an eddy current cutting-off structure that is formed on the rotating body and cuts-off a portion of eddy current generated by the electromagnetic induction.

22 Claims, 8 Drawing Sheets

HEATING ROTATING BODY, HEATING DEVICE, FIXING DEVICE AND IMAGE FORMING DEVICE

CROSS-REFERENCE TO RELATED APPLICATION

This application is based on and claims priority under 35 USC 119 from Japanese Patent Application No. 2008-136077 filed on May 23, 2008.

BACKGROUND

1. Technical Field

The present invention relates a heating rotating body, a heating device, a fixing device and an image forming device.

2. Related Art

Conventionally, there are electromagnetic induction heat-generating type fixing devices that use, as the heat source, a coil that generates a magnetic field by being energized, and a heat-generating body that generates heat by eddy current arising due to electromagnetic induction of the magnetic field.

SUMMARY

A heating rotating body relating to a first aspect of the present invention includes: a rotating body that generates heat due to electromagnetic induction in a magnetic field and whose magnetic permeability starts to decrease continuously from a magnetic permeability change start temperature that is in a temperature region that is greater than or equal to a set temperature and less than or equal to a heat-resistant temperature, and an eddy current cutting-off structure that is formed on the rotating body and cuts-off a portion of eddy current generated by the electromagnetic induction.

BRIEF DESCRIPTION OF THE DRAWINGS

Exemplary embodiments of the present invention will be described in detail based on the following figures, wherein.

DETAILED DESCRIPTION

Exemplary embodiments of a heating rotating body, a heating device, a fixing device and an image forming device of the present invention will be described on the basis of the drawings.

Figure 1:
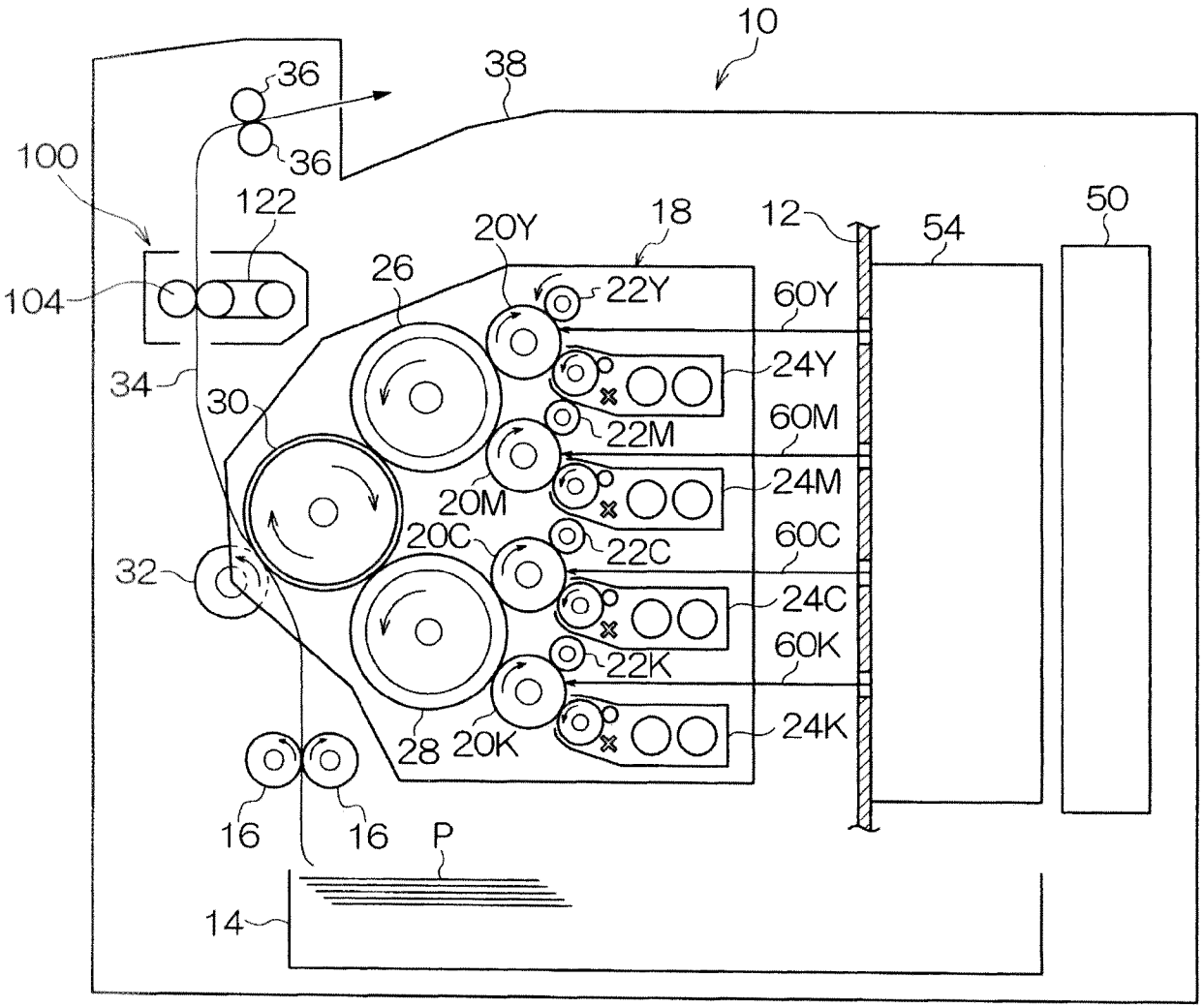
FIG. 1 is an overall view of an image forming device relating to an exemplary embodiment of the present invention.

A printer 10 serving as an image forming device is shown in FIG. 1. In the printer 10, a light scanning device 54 is fixed to a housing 12 that structures the main body of the printer 10. A control unit 50, that controls the operations of the light scanning device 54 and each of the sections of the printer 10, is provided at a position adjacent to the light scanning device 54.

In the light scanning device 54, a light beam that exits from an unillustrated light source is scanned at a rotating polygon mirror and reflected by plural optical parts such as reflecting mirrors and the like, and light beams 60Y, 60M, 60C, 60K corresponding to respective toners of yellow (Y), magenta (M), cyan (C) and black (K) exit. The light beams 60Y, 60M, 60C, 60K are guided to photoconductive bodies 20Y, 20M, 20C, 20K corresponding respectively thereto.

A sheet tray 14 that accommodates recording sheets P is provided at the lower side of the printer 10. A pair of registration rollers 16, that adjust the position of the leading end portion of the recording sheet P, are provided above the sheet tray 14. An image forming unit 18 is provided at the central portion of the printer 10. The image forming unit 18 is equipped with the four photoconductive bodies 20Y, 20M, 20C, 20K, and they are lined up in a row vertically.

Charging rollers 22Y, 22M, 22C, 22K, that charge the surfaces of the photoconductive bodies 20Y, 20M, 20C, 20K, are provided at the upstream sides in the directions of rotation of the photoconductive bodies 20Y, 20M, 20C, 20K. Developing units 24Y, 24M, 24C, 24K, that develop the toners of Y, M, C, K on the photoconductive bodies 20Y, 20M, 20C, 20K respectively, are provided at the downstream sides in the directions of rotation of the photoconductive bodies 20Y, 20M, 20C, 20K.

A first intermediate transfer body 26 contacts the photoconductive bodies 20Y, 20M, and a second intermediate transfer body 28 contacts the photoconductive bodies 20C, 20K. A third intermediate transfer body 30 contacts the first intermediate transfer body 26 and the second intermediate transfer body 28. A transfer roller 32 is provided at a position opposing the third intermediate transfer body 30. Due thereto, the recording sheet P is transported between the transfer roller 32 and the third intermediate transfer body 30, and the toner image on the third intermediate transfer body 30 is transferred onto the recording sheet P.

A fixing device 100 is provided downstream of a sheet transporting path 34 on which the recording sheet P is transported. The fixing device 100 has a fixing belt 122 and a pressure roller 104. The recording sheet P is heated and pressure is applied thereto, and the toner image is fixed on the recording sheet P. The recording sheet P on which the toner image is fixed is discharged-out by sheet transporting rollers 36 to a tray 38 provided at the top portion of the printer 10.

Image formation of the printer 10 will be described next.

When image formation is started, the surfaces of the photoconductive bodies 20Y through 20K are charged uniformly by the respective charging rollers 22Y through 22K. Then, the light beams 60Y through 60K that correspond to the output image are illuminated from the light scanning device 54 onto the charged surfaces of the photoconductive bodies 20Y through 20K, and electrostatic latent images corresponding to respective color separation images are formed on the photoconductive bodies 20Y through 20K. The developing units 24Y through 24K selectively apply toners of the respective colors, i.e., Y through K, onto the electrostatic latent images, such that toner images of the colors Y through K are formed on the photoconductive bodies 20Y through 20K.

Thereafter, the magenta toner image is primarily transferred from the photoconductive body 20M for magenta to the first intermediate transfer body 26. Further, the yellow toner image is primarily transferred from the photoconductive body 20Y for yellow to the first intermediate transfer body 26, and is superposed on the magenta toner image on the first intermediate transfer body 26.

Similarly, the black toner image is primarily transferred from the photoconductive body 20K for black to the second intermediate transfer body 28. Further, the cyan toner image is primarily transferred from the photoconductive body 20C for cyan to the second intermediate transfer body 28, and is superposed on the black toner image on the second intermediate transfer body 28.

The magenta and yellow toner images, that were primarily transferred onto the first intermediate transfer body 26, are secondarily transferred onto the third intermediate transfer body 30. On the other hand, the black and cyan toner images, that were primarily transferred onto the second intermediate transfer body 28, also are secondarily transferred onto the third intermediate transfer body 30. Here, the magenta and yellow toner images, that were secondarily-transferred previously, and the cyan and black toner images, are superposed on one another, such that a full color toner image of colors (three colors) and black is formed on the third intermediate transfer body 30.

The full color toner image that is secondarily transferred reaches the nip portion between the third intermediate transfer body 30 and the transfer roller 32. Synchronously with the timing thereof, the recording sheet P is transported from the registration rollers 16 to the nip portion, and the full color toner image is tertiarily transferred onto the recording sheet P (final transfer).

Thereafter, the recording sheet P is sent to the fixing device 100, and passes-through the nip portion between the fixing belt 102 and the pressure roller 104. At this time, due to the working of the heat and the pressure provided from the fixing belt 102 and the pressure roller 104, the full color toner image is fixed on the recording sheet P. After fixing, the recording sheet P is discharged-out to the tray 38 by the sheet transporting rollers 36, and the formation of a full color image onto the recording sheet P ends.

The fixing device 100 relating to the present exemplary embodiment will be described next.

Figure 2:
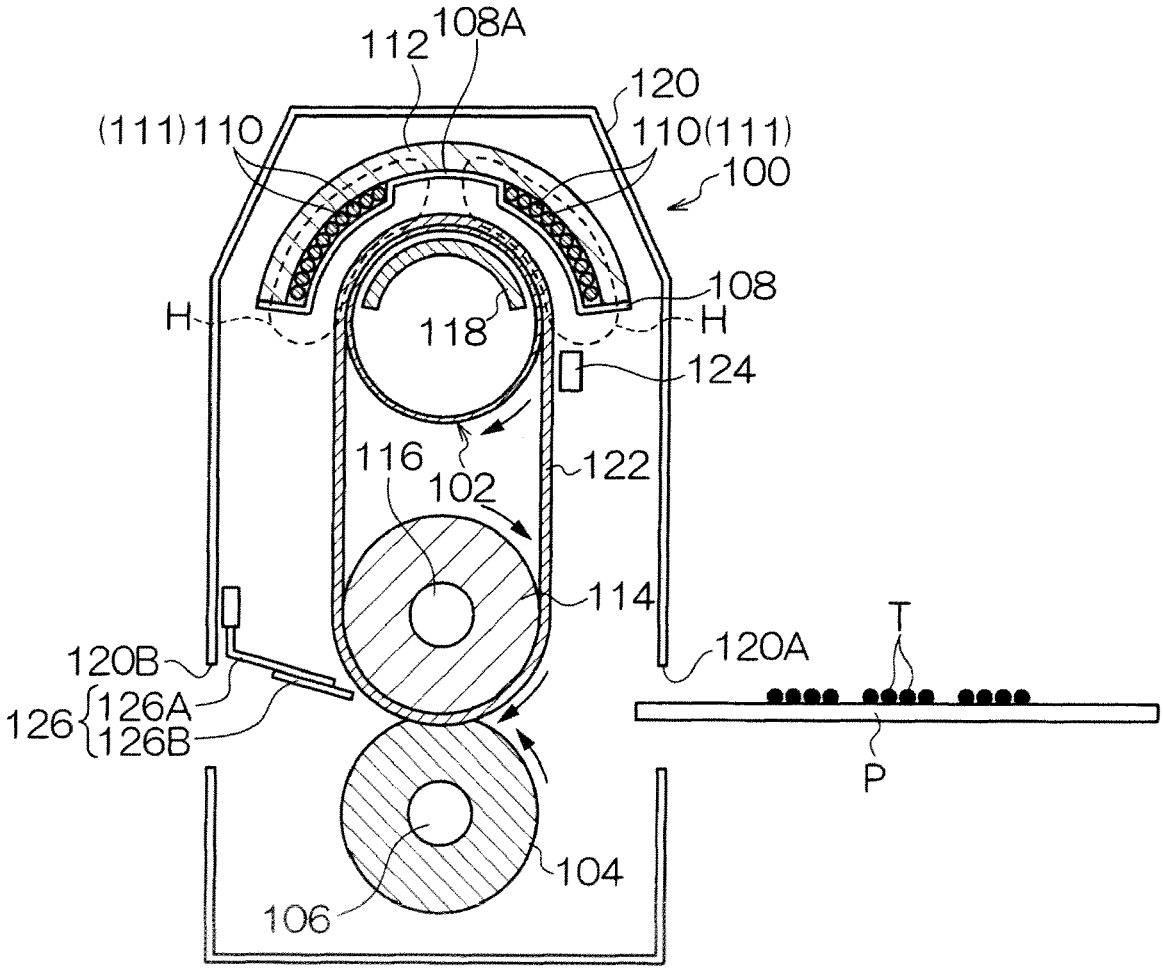
FIG. 2 is a cross-sectional view of a fixing device relating to the exemplary embodiment of the present invention.

As shown in FIG. 2, the fixing device 100 has a housing 120 in which are formed openings 120A, 120B for carrying out entry and discharging of the recording sheet P. A temperature-sensitive roller 102 serving as a heating rotating body is provided at the interior of the housing 120. Both end portions of the temperature-sensitive roller 102 are rotatably supported via bearings at shaft portions that are hollow and are formed at unillustrated side walls of the housing 120. Further, a gear, that is connected to a motor (not shown) that rotates and drives the temperature-sensitive roller 102, is adhered to one end of the temperature-sensitive roller 102. Here, when the motor operates, the temperature-sensitive roller 102 rotates in the direction of the arrow.

A bobbin 108, that is structured by an insulating material, is disposed at a position opposing the outer peripheral surface of the temperature-sensitive roller 102. The bobbin 108 is formed substantially in the shape of an arc that follows the outer peripheral surface of the temperature-sensitive roller 102. A convex portion 108A is provided so as to project-out from the substantially central portion of the surface of the bobbin 108 at the side opposite the temperature-sensitive roller 102. The gap between the bobbin 108 and the temperature-sensitive roller 102 is around 1 to 3 mm.

An excitation coil 110, that generates a magnetic field H by being energized, is wound plural times in the axial direction (the direction perpendicular to the surface of the drawing of FIG. 2) around the convex portion 108A. A magnetic body core 112, that is formed in a substantial arc shape following the arc shape of the bobbin 108, is disposed at a position opposing the excitation coil 110, and is supported by the bobbin 108. Note that, in the fixing device 100, a heating section 111 serving as a heating device is structured by the excitation coil 110 and the temperature-sensitive roller 102.

An induction body 118 is provided at the inner side of the temperature-sensitive roller 102, at a position that is apart from the inner peripheral surface of the temperature-sensitive roller 102 by 1.0 to 1.5 mm. The induction body 118 is formed from aluminum that is a non-magnetic body, and is formed in the shape of an arc facing along the inner peripheral surface of the temperature-sensitive roller 102. Both ends of the induction body 118 are fixed to the aforementioned shaft portions of the housing 120. The induction body 118 is disposed in advance at a position at which it induces magnetic flux of a magnetic field H when the magnetic flux of the magnetic field H passes-through a temperature-sensitive layer 103, that will be described later, of the temperature-sensitive roller 102.

A tensioning roller 114 serving as a tensioning rotating body is disposed at the side of the temperature-sensitive roller 102 opposite the side at which the bobbin 108 is located, at a position that is separated by a predetermined distance (e.g., 30 mm). The tensioning roller 114 is structured by a core metal 116, and a silicon rubber layer and a releasing layer that cover the periphery of the core metal 116. The tensioning roller 114 is provided such that the core metal 116 is rotatable at the housing 120.

The fixing belt 122 serving as a fixing member is trained around the temperature-sensitive roller 102 and the tensioning roller 114. Here, when the temperature-sensitive roller 102 rotates in the direction of the arrow due to the rotation of the motor, the fixing belt 122 rotates, and the tensioning roller 114 rotates in the same direction as the temperature-sensitive roller 102.

The pressure roller 104, that slave-rotates with respect to the rotation of the fixing belt 122, is provided at a position opposing the tensioning roller 114, with the fixing belt 122 nipped therebetween. The pressure roller 104 is structured such that a foamed silicon rubber sponge elastic layer of a thickness of 5 mm is provided at the periphery of a core metal 106 that is formed from a metal such as aluminum or the like, and the outer side of this foamed silicon rubber sponge elastic layer is covered by a releasing layer formed from carbon-containing PFA of a thickness of 50 μm.

Because the pressure roller 104 is press-contacting the outer peripheral surface of the fixing belt 122, at the contact portion (nip portion) of the fixing belt 122 and the pressure roller 104, the outer peripheral surface of the pressure roller 104 is concave. Here, the pressure roller 104 contacts the outer peripheral surface of the fixing belt 122, applies pressure to the fixing belt 122 in the direction toward the tensioning roller 114, and fixes the toner image T, that passes-through between the pressure roller 104 and the fixing belt 122, to the recording sheet P.

On the other hand a non-contact-type temperature sensor 124, that measures the temperature of the fixing belt 122, is provided at a position opposing the outer peripheral surface of the fixing belt 122 at the temperature-sensitive roller 102 side. The temperature sensor 124 has a thermocouple, and indirectly estimates and measures the surface temperature of the fixing belt 122 by temperature-converting the heat amount provided from the fixing belt 122. The mounting position of the temperature sensor 124 is a substantially central portion in the transverse direction of the fixing belt 122, such that the measured value does not change in accordance with the magnitude of the size of the recording sheet P.

Figure 4A:
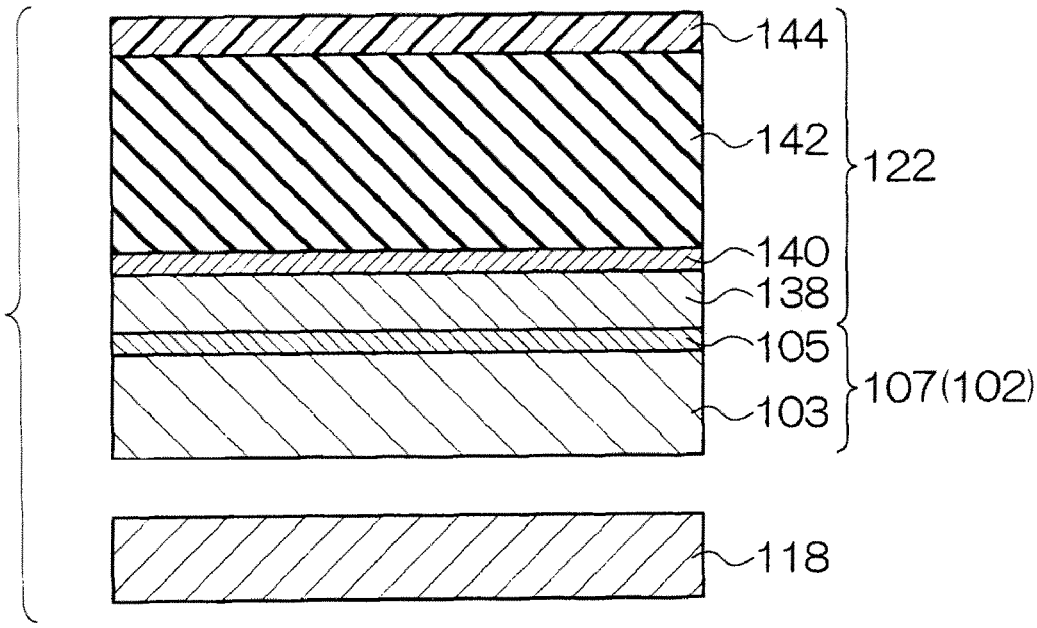
FIG. 4A is a cross-sectional view of the temperature-sensitive roller and a fixing belt relating to the exemplary embodiment of the present invention.
Figure 4B:
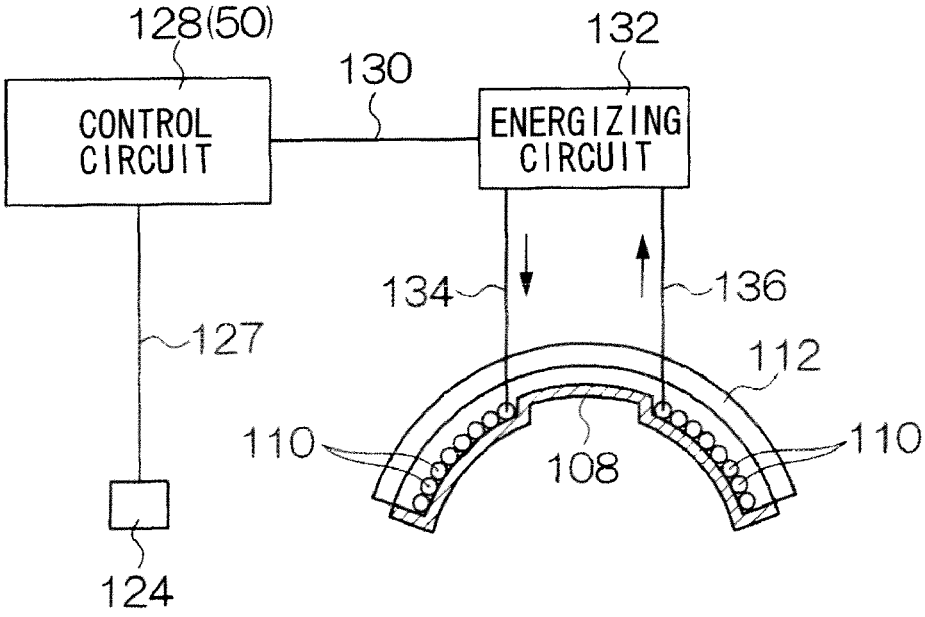
FIG. 4B is a connection diagram of a control circuit and an energizing circuit relating to the exemplary embodiment of the present invention.

As shown in FIG. 4B, the temperature sensor 124 is connected, via a wire 127, to a control circuit 128 provided at the interior of the aforementioned control unit 50 (see FIG. 1). Further, the control circuit 128 is connected to an energizing circuit 132 via a wire 130. The energizing circuit 132 is connected to the aforementioned excitation coil 110 via wires 134, 136. The energizing circuit 132 is driven or the driving thereof is stopped on the basis of electric signals sent from the control circuit 128. The energizing circuit 132 supplies (in the directions of the arrows) or stops the supply of AC current of a predetermined frequency to the excitation coil 110 via the wires 134, 136.

Here, the control circuit 128 carries out temperature conversion on the basis of an electrical amount sent from the temperature sensor 124, and measures the temperature of the surface of the fixing belt 122. Then, the control circuit 128 compares this measured temperature and a set fixing temperature that is stored in advance (170° C. in the present exemplary embodiment). If the measured temperature is lower than the set fixing temperature, the control circuit 128 drives the energizing circuit 132 and energizes the excitation coil 110, and causes the magnetic field H (see FIG. 2) serving as a magnetic circuit to be generated. If the measured temperature is higher than the set fixing temperature, the control circuit 128 stops the energizing circuit 132.

On the other hand, a peeling member 126 is provided at the exit side of the contact portion (nip portion) of the fixing belt 122 and the pressure roller 104. The peeling member 126 is structured by a supporting portion 126A whose one end is fixed, and a peeling sheet 126B supported at the supporting portion 126A. The distal end of the peeling sheet 126B is disposed so as to be adjacent to or contact the fixing belt 122.

The structure of the temperature-sensitive roller 102 will be described next.

Figure 3A:
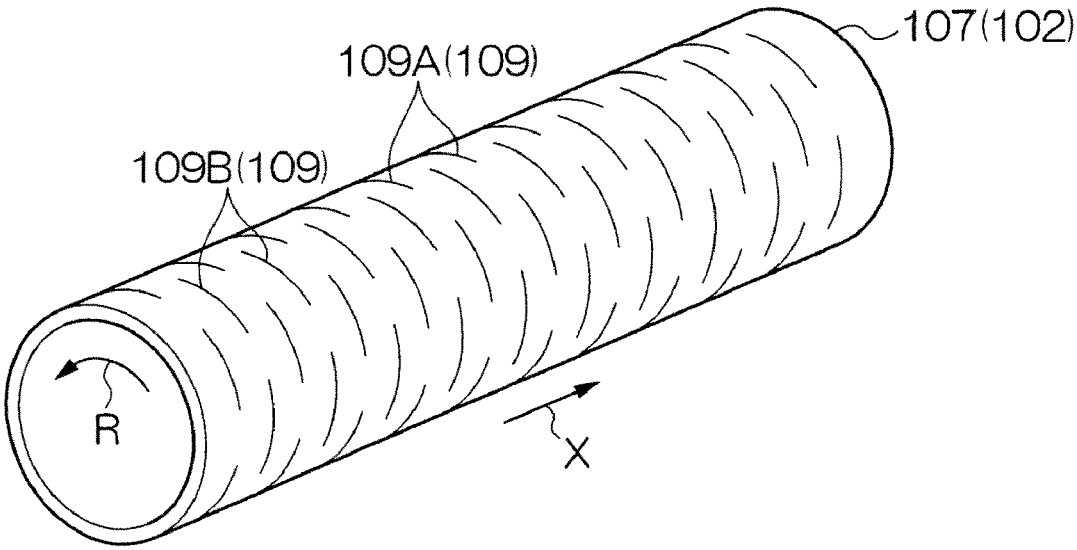
FIG. 3A is a perspective view showing a state in which slits are formed in a temperature-sensitive roller relating to the exemplary embodiment of the present invention.
Figure 3B:
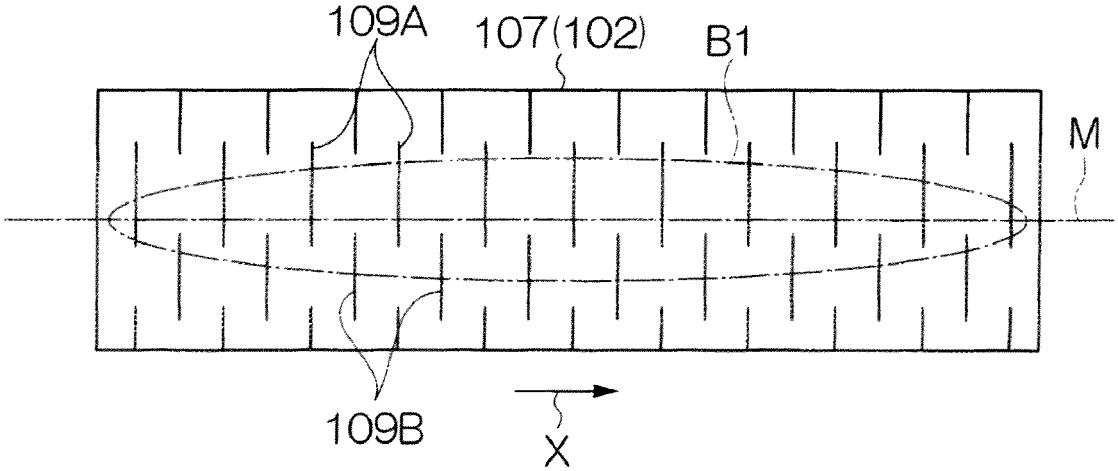
FIG. 3B is a schematic drawing showing a state in which eddy current, that flows at a temperature-sensitive layer relating to the exemplary embodiment of the present invention, is cut-off by the slits.

As shown in FIG. 3A, FIG. 3B and FIG. 4A, the temperature-sensitive roller 102 is structured by a multilayer roller 107 and plural slits 109. At the multilayer roller 107, the temperature-sensitive layer 103 of a thickness of 200 μm (150 to less than or equal to 200 μm), and a releasing layer 105 of a thickness of 30 μm and formed from PFA, are layered and made integral from the inner side toward the outer side. The plural slits 109 that functions openings (cuts) are formed in the outer peripheral surface of the multilayer roller 107.

The temperature-sensitive layer 103 is positioned at a base layer for maintaining the strength of the temperature-sensitive roller 102. A metal, soft magnetic material formed by an alloy formed from iron, nickel, chromium, silicon, boron, niobium, copper, zirconium, cobalt, or the like is used for the temperature-sensitive layer 103. Further, a material having a magnetic permeability change start temperature, at which the magnetic permeability starts to decrease continuously, in a temperature region that is less than or equal to the heat-resistant temperature of the temperature-sensitive roller 102 (the temperature at which deterioration of functions, deformation, and the like due to heat start) and greater than or equal to a set fixing temperature of the fixing device 100 (the fixing temperature required at the temperature-sensitive roller 102), is used for the temperature-sensitive layer 103.

Figure 5:
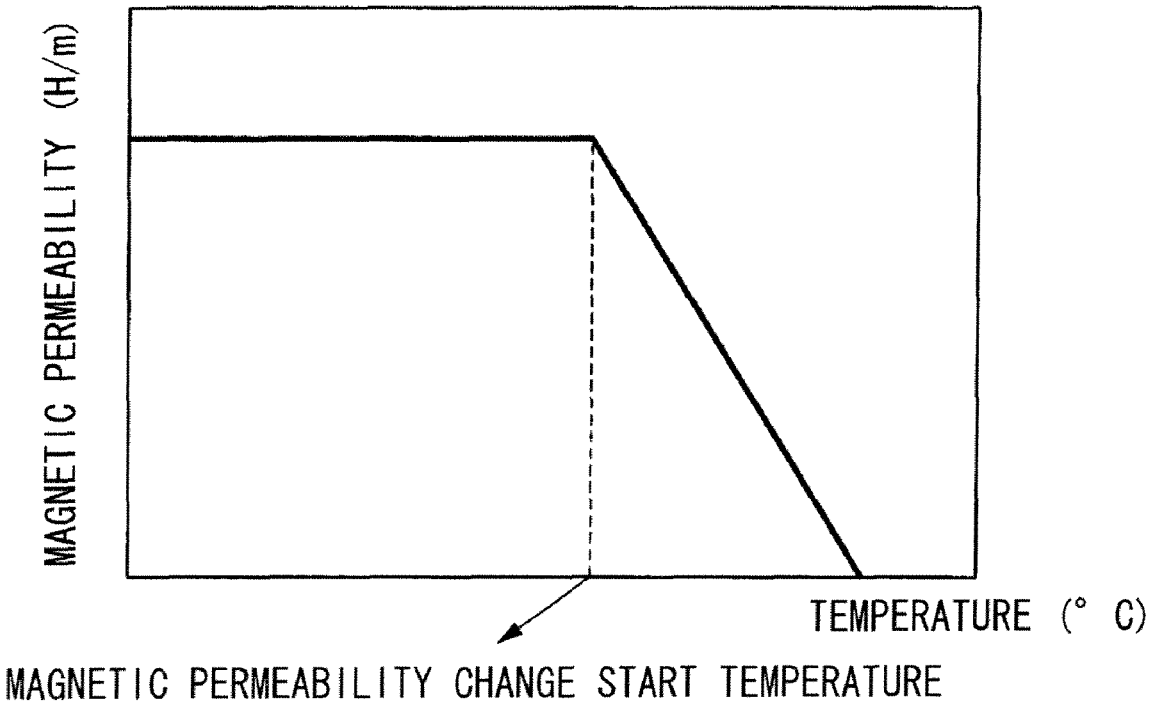
FIG. 5 is a schematic drawing showing the relationship between magnetic permeability and temperature of a temperature-sensitive magnetic member relating to the exemplary embodiment of the present invention.

As shown in FIG. 5, the magnetic permeability change start temperature is the temperature at which the magnetic permeability (measured in accordance with JIS-C2531) starts to decrease continuously, and is the point where the pass-through amount of the magnetic flux of the magnetic field starts to change. Further, the magnetic permeability change start temperature is different than the Curie point, and is preferably set to 150° C. to 230° C.

In the present exemplary embodiment, the heat-resistant temperature is set to 240° C. and the set fixing temperature is set to 170° C. An iron-nickel alloy whose magnetic permeability change start temperature is around 210° C. is used as the temperature-sensitive layer 103. The specific resistance of the temperature-sensitive layer 103 is greater than or equal to $60\times10^{-8}$ Ωm, and the thickness thereof is 200 μm.

At temperature lower than the magnetic permeability change start temperature, the temperature-sensitive layer 103 is a strong magnetic body, and the aforementioned magnetic field H (see FIG. 2) penetrates the temperature-sensitive layer 103. When the temperature-sensitive layer 103 exceeds the magnetic permeability change start temperature, the magnetic permeability starts to decrease. When the temperature reaches the Curie point, the temperature-sensitive layer 103 becomes a non-magnetic body (paramagnetic body), the magnetic flux density decreases, and the magnetic flux pass-through amount of the magnetic field H becomes very large.

In order to sufficiently exhibit the temperature-sensitive function of the temperature-sensitive layer 103, a skin depth δ, that expresses the depth to which the magnetic field H can penetrate at a temperature lower than the magnetic permeability change start temperature, must be made to be less than or equal to the thickness of the temperature-sensitive layer 103. The skin depth is δ is given by formula (1). Conversely, it can be said that the thickness of the temperature-sensitive layer 103 must be greater than or equal to the skin depth δ.

[Formula 1]

$$\delta = 503\sqrt{\frac{\rho}{f\cdot\mu_r}} \tag{1}$$

In formula (1), ρ is the specific resistance, f is the frequency (electromagnetic induction heating frequency), and $\mu_r$ is the relative magnetic permeability (at room temperature). For example, with $\rho \geqq 70\times10^{-8}$ Ωm and f≧20 kHz being necessary conditions, when the relative magnetic permeability at which for example δ≦200 μm is determined on the basis of formula (1), there is the need at least for the relative magnetic permeability $\mu_r \geqq 230$. In order for the relative magnetic permeability $\mu_r$ to be greater than or equal to 230, a temperature-sensitive layer 103 in the present exemplary embodiment is made to have high magnetic permeability in advance by a heat treatment (annealing). The specific resistance ρ of the material of the temperature-sensitive layer 103 is determined, for example, by the method of JIS K7194 or the like.

On the other hand, the slit 109 is structured by a cut of a length of 10 mm and a width of 0.2 mm. The slits 109 are formed in a direction intersecting the direction in which eddy current B1, that is generated by the working of the electromagnetic induction of the excitation coil 110 (see FIG. 2), flows (i.e., the slits 109 are formed in a direction cutting-off the loop). In the present exemplary embodiment, the direction in which the slits 109 are formed is the same as the direction of rotation of the temperature-sensitive roller 102 (the direction of arrow R).

The plural slits 109 are structured by first slit rows 109A, at which slits are formed at 11 places at uniform intervals of 15 mm in the transverse direction of the temperature-sensitive roller 102 (the direction of arrow X), and second slit rows 109B, at which slits are formed at 10 places similarly at uniform intervals of 15 mm. The slits of the first slit rows 109A and the second slit rows 109B are staggered so as to be offset from one another, and are all disposed uniformly over the entire peripheral direction of the temperature-sensitive roller 102.

Both end portions of the slits 109 of the first slit rows 109A and the second slit rows 109B extend out from a transverse direction central line M of the temperature-sensitive roller 102, such that the each of the end portions overlap one another as seen in the transverse direction. Here, the eddy current amount that is generated at the temperature-sensitive roller 102 is adjusted by changing the amount (number) of the slits 109, the slit interval, and the range of overlapping of the slits.

The structure of the fixing belt 122 will be described next.

As shown in FIG. 4A, the fixing belt 122 is structured by a base layer 138 formed from polyimide and of a thickness of 200 μm (150 to less than or equal to 200 μm), a heat-generating layer 140 of a thickness of 12 μm (5 to 20 μm), an elastic layer 142 of a thickness of 400 μm, and a releasing layer 144 of a thickness of 30 μm, being laminated and made integral from the inner side toward the outer side. Further, the diameter of the fixing belt 122 is 30 mm, and the transverse direction length thereof is 300 mm.

A metal material, that generates heat by the working of electromagnetic induction in which eddy current flows so as to generate a magnetic field that cancels the aforementioned magnetic field H (see FIG. 2), is used as the heat-generating layer 140. Examples of such a metal material include gold, silver, copper, aluminum, zinc, tin, lead, bismuth, beryllium, antimony, and alloys thereof. Further, also in order to shorten the warn-up time of the fixing device 100, it is better to make the thickness of the heat-generating layer 140 as thin as possible. If a non-magnetic metal material whose thickness is 5 to 20 μm and whose specific resistance is less than or equal to $2.7\times10^{-8}$ Ωcm is used as the heat-generating layer 140, the needed heat generation amount can be obtained efficiently in the range of AC frequency of 20 kHz to 100 kHz that a general-use power source can utilize. If the thickness is less than 5 μm, when forming the heat-generating layer 140 by plating or a metal paste, it is difficult to structure a uniform layer and a non-uniform temperature distribution arises. Therefore, a thickness of greater than or equal to 5 μm is preferable. Further, if the thickness is greater than 20 μm, the resistance value of the heat-generating layer 140 is small, and therefore, it is difficult to obtain eddy current loss. Thus, a thickness of less than or equal to 20 μm is preferable. In the present exemplary embodiment, from the standpoints of heat-generating efficiency and cost, copper is used, and the thickness thereof is made to be 12 μm. Because this is sufficiently thinner than the skin depth δ, the magnetic flux passes-through.

From the standpoint of obtaining excellent elasticity and heat resistance, and the like, a silicon rubber or a fluorine rubber is used as the elastic layer 142. In the present exemplary embodiment, silicon rubber is used.

The releasing layer 144 is provided in order to weaken the adhesive force with the toner T (see FIG. 2) that is fused on the recording sheet P, and make the recording sheet P peel-away easily from the fixing belt 122. In order to obtain excellent surface releasability, a fluorine resin, silicon resin, or polyimide resin is used as the releasing layer 144, and PFA (tetrafluoroethylene-perfluoroalkoxyethylene copolymer resin) is used in the present exemplary embodiment.

Operation of the exemplary embodiment of the present invention will be described next.

As shown in FIG. 1, the recording sheet P, on which the toner T has been transferred through the above-described image forming processes of the printer 10, is sent to the fixing device 100.

Next, at the fixing device 100, the motor (not shown) is driven by the control unit 50, and the temperature-sensitive roller 102 rotates in the direction of the arrow. Due thereto, the fixing belt 122, the tensioning roller 114, and the pressure roller 104 rotate. At this time, the energizing circuit 132 is driven on the basis of the electric signal from the control circuit 128, and AC current is supplied to the excitation coil 110.

Figure 6A:
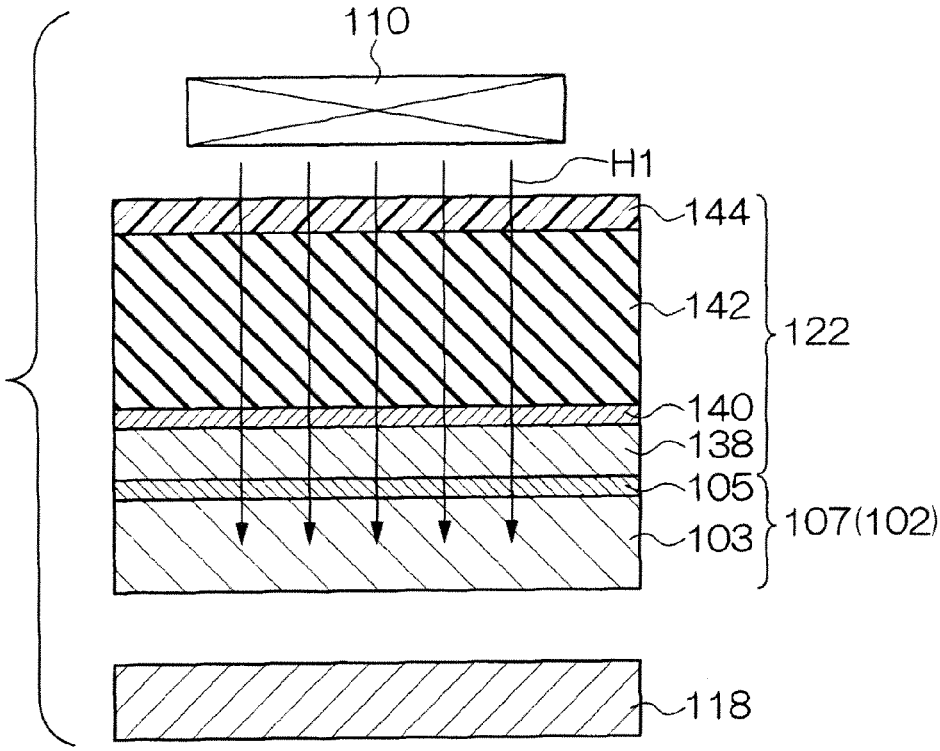
FIG. 6A and FIG. 6B are schematic drawings showing states in which a magnetic field passes-through the fixing belt and the temperature-sensitive roller relating to the exemplary embodiment of the present invention.

Here, as shown in FIG. 6A, when AC current is supplied to the excitation coil 110, generation and extinction of the magnetic field H serving as a magnetic circuit are repeated at the periphery of the excitation coil 110. Then, when the magnetic field H traverses the heat-generating layer 140 of the fixing belt 122, eddy current is generated at the heat-generating layer 140 such that a magnetic field that impedes changes in the magnetic field H arises. The heat-generating layer 140 generates heat in proportion to the magnitudes of the surface skin resistance of the heat-generating layer 140 and the eddy current flowing through the heat-generating layer 140, and the fixing belt 122 is heated thereby. Note that the magnetic field H reaches the temperature-sensitive layer 103 of the temperature-sensitive roller 102, and forms a closed magnetic path.

Next, as shown in FIG. 1, the recording sheet P that is sent into the fixing device 100 is heated and pressed by the fixing belt 122, that has become the predetermined set fixing temperature (170° C.), and the tensioning roller 114 and the pressure roller 104, such that the toner image is fixed on the surface of the recording sheet P. The recording sheet P, that is discharged from the fixing device 100, is discharged-out to the tray 38 by the sheet transporting rollers 36.

Operation of the temperature-sensitive roller 102 will be described next.

As shown in FIG. 6A, a magnetic field H1 generated at the excitation coil 110 penetrates to the temperature-sensitive layer 103. Because the temperature-sensitive layer 103 is metal, eddy current is generated due to the working of the electromagnetic induction of the magnetic field H1 at the temperature-sensitive layer 103 as well, and starts to generate heat.

However, as shown in FIG. 3B, a large flow of eddy current B1 that starts to be generated at the temperature-sensitive layer 103 is cut-off by the slits 109. Only extremely slight eddy current is generated between the slits 109 of the temperature-sensitive layer 103, and an excessive rise in the temperature of the temperature-sensitive roller 102 is suppressed. Therefore, the heat generation amount of the temperature-sensitive layer 103 is of an extent that hardly affects the heat generation amount of the heat-generating layer 140 of the fixing belt 122 at all.

Figure 7:
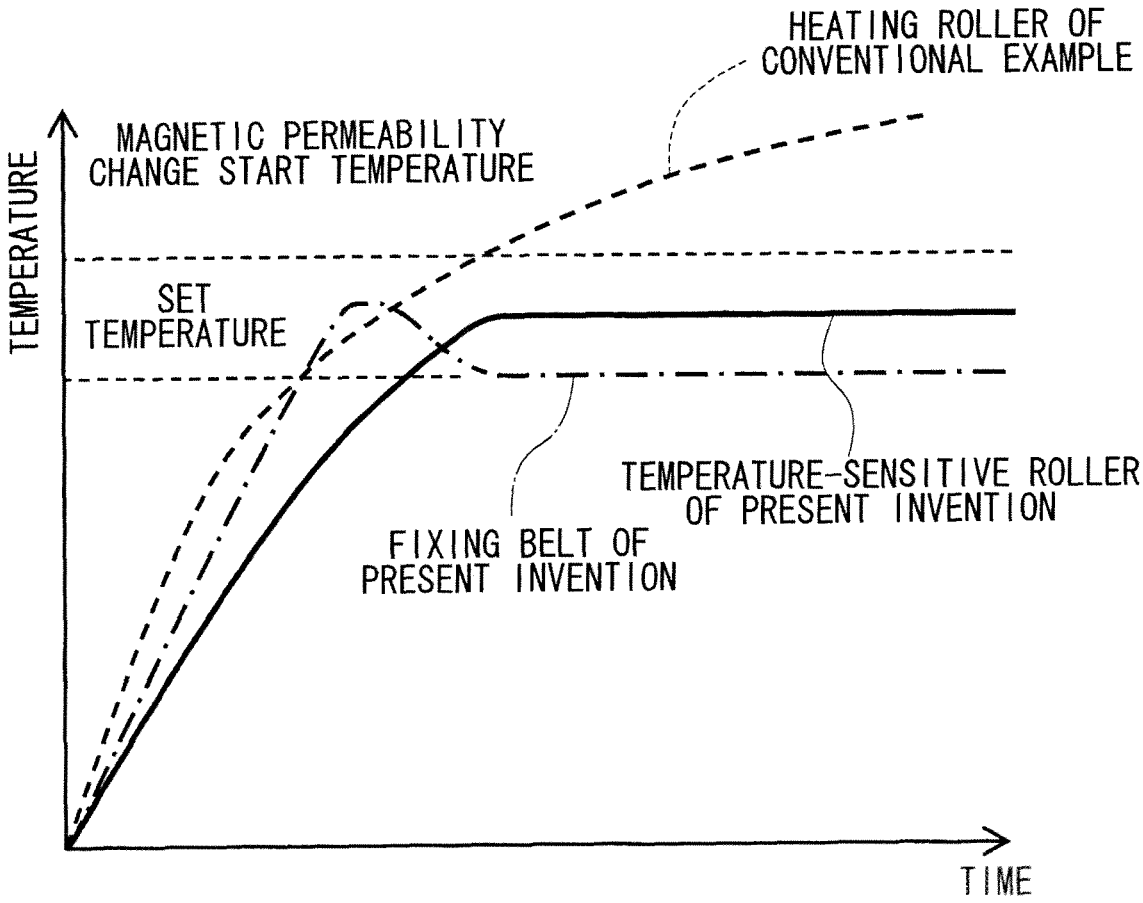
FIG. 7 is a graph comparing the relationships between time and temperature, in the case of the temperature-sensitive roller and the fixing belt relating to the exemplary embodiment of the present invention and in the case of a heating roller of a conventional example.

Due thereto, as shown in FIG. 7, the peak temperature of the fixing belt 122 at the time of temperature raising is kept lower than in a case using a conventional heating roller at which there are no slits 109 and excessive heating is carried out. Further, when the temperature of the fixing belt 122 decreases in the continuous fixing of plural recording sheets P, even if the excitation coil 110 is energized and temperature raising carried out, there is almost only heat generation at the heat-generating layer 140 of the fixing belt 122. Therefore, the temperature of the fixing belt 122 can be made to be a temperature near the set fixing temperature.

In this way, in a case of using the fixing device 100 of the present exemplary embodiment, the heat generation amount due to self heat generation of the temperature-sensitive roller 102 is suppressed, and an excessive rise in temperature of the temperature-sensitive roller 102 and the fixing belt 122 is suppressed. Therefore, it is difficult for a state to arise in which the toner T is fused at a temperature higher than needed, and dirtying of the image is suppressed.

Figure 6B:
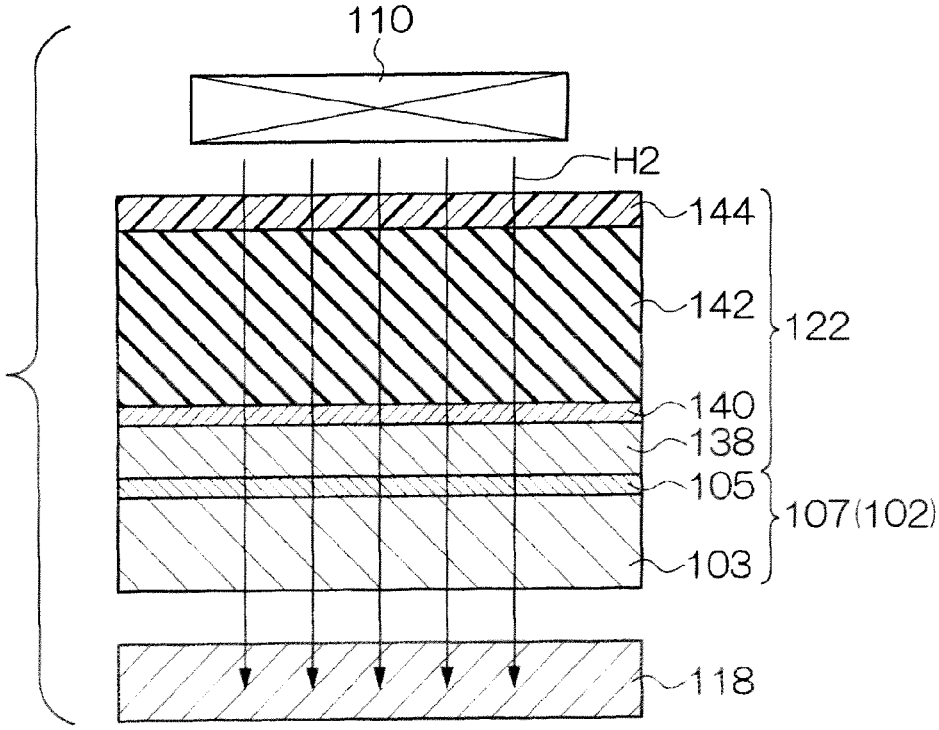

Then, as shown in FIG. 6B, when the temperature of the temperature-sensitive layer 103 becomes greater than or equal to the magnetic permeability change start temperature, the magnetic permeability of the temperature-sensitive layer 103 decreases, and therefore, the magnetic field H1 passes-through the temperature-sensitive layer 103 and heads toward the induction body 118. At this time, because the magnetic field H1 passes-through the induction body 118 as well, it is difficult to form a closed magnetic path, the magnetic field H1 weakens and becomes magnetic field H2, and the heat generation amount of the heat-generating layer 140 decreases. Due thereto, a rise in temperature of the fixing belt 122 that is greater than needed is suppressed, as shown in FIG. 7.

Figure 8A:
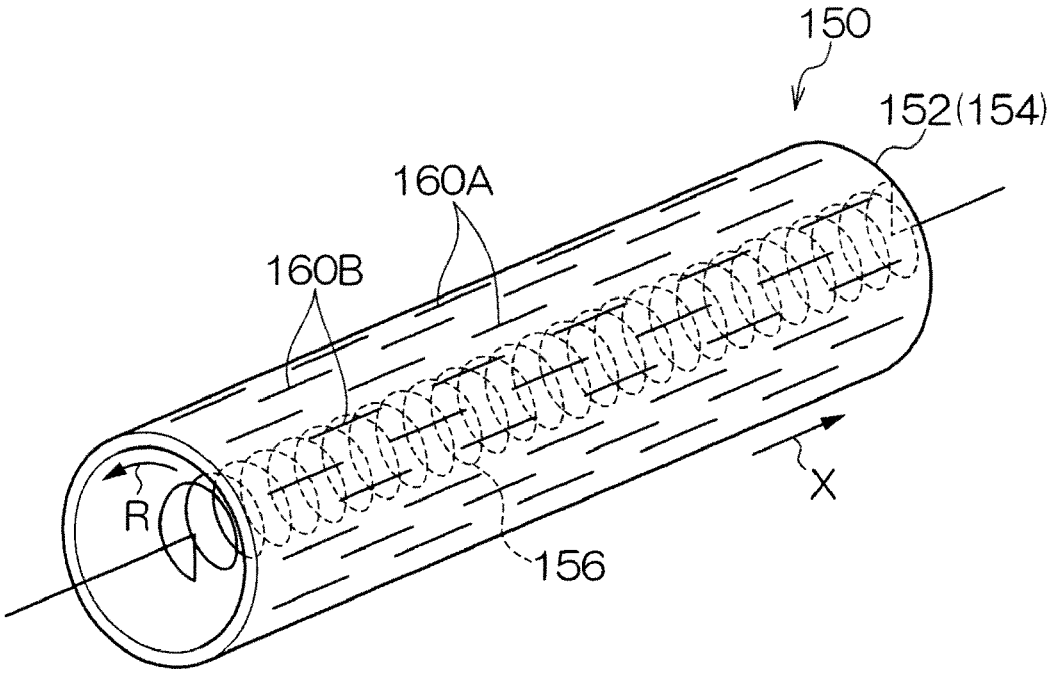
FIG. 8A is a perspective view showing a state in which slits are formed in a temperature-sensitive roller as another exemplary embodiment of the present invention.
Figure 8B:
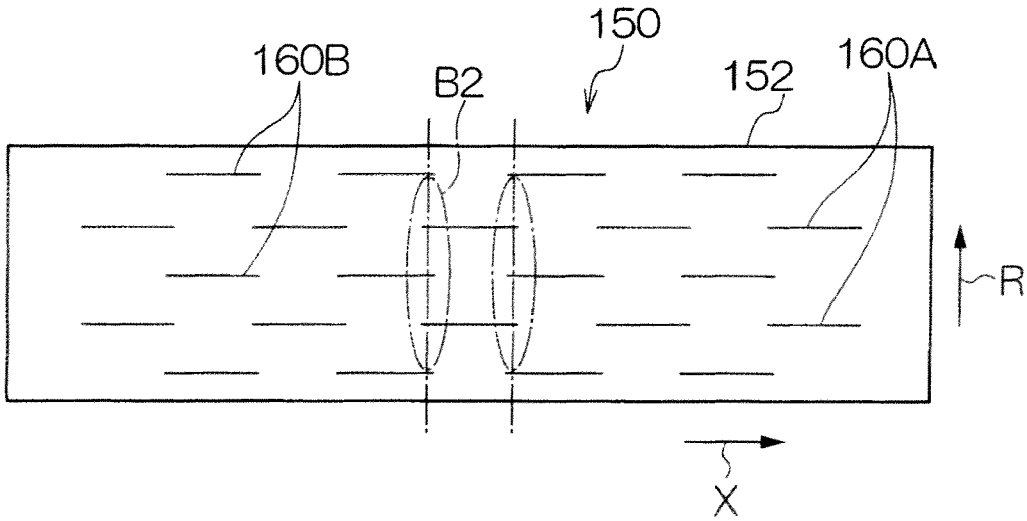
FIG. 8B is a schematic drawing showing a state in which eddy current that flows at a temperature-sensitive layer is cut-off by the slits as the other exemplary embodiment of the present invention.

Note that, as shown in FIG. 8A and FIG. 8B, as another exemplary embodiment of the temperature-sensitive roller 102, a temperature-sensitive roller 150 of a type that envelops an excitation coil can also be used.

The temperature-sensitive roller 150 is structured by a multilayer roller 154 that is shaped as a cylindrical tube, and at which a temperature-sensitive layer 152 formed of a similar material as the temperature-sensitive layer 103 is disposed at the inner side, and a releasing layer is layered at the outer side. A spiral excitation coil 156 is inserted through the center of the inner side of the multilayer roller 154 from one end to the other end.

The excitation coil 156 is connected to an unillustrated energizing circuit, and generates a magnetic field by being energized. An unillustrated induction body formed from a non-magnetic body is provided at a position opposing the outer peripheral surface of the multilayer roller 154.

Plural slits 160 are formed in the multilayer roller 154. The slit 160 is structured by a cut of a length of 10 mm and a width of 0.2 mm. The slits 160 are formed in a direction intersecting the direction in which eddy current B2, that is generated by the working of the electromagnetic induction of the excitation coil 156, flows (i.e., the slits 160 are formed in a direction cutting-off the loop). Here, the direction in which the slits 160 are formed is the same as the transverse direction of the multilayer roller 154 (the direction of arrow X).

The plural slits 160 are structured by first slit rows 160A, at which slits are formed at five places at uniform intervals of 15 mm in the transverse direction of the multilayer roller 154 (the direction of arrow X), and second slit rows 160B, at which slits are formed at four places at uniform intervals of 15 mm in the transverse direction at positions that are offset by 15 mm in the peripheral direction from the first slit rows 160A.

The slits of the first slit rows 160A and the second slit rows 160B are staggered so as to be offset from one another. Note that the first slit rows 160A and the second slit rows 160B are provided alternately at uniform intervals over the entire peripheral direction of the multilayer roller 154. Further, both end portions of each of the slits 160 of the first slit rows 160A and the second slit rows 160B overlap one another in the transverse direction of the multilayer roller 154. Here, the eddy current amount that is generated at the temperature-sensitive roller 150 is adjusted by changing the amount (number) of the slits 160, the slit interval, and the range of overlapping of the slits.

With this temperature-sensitive roller 150, when the eddy current B2 forms plural loops that extend in the peripheral direction, the loops of the eddy current B2 are cut-off and heat generation of the temperature-sensitive layer 152 is suppressed by forming the slits 160 that extend in the transverse direction. An excessive rise in temperature of the temperature-sensitive roller 150 is thereby suppressed.

Note that the present invention is not limited to the above-described exemplary embodiments.

The printer 10 does not have to be a dry-type electrophotographic printer using a solid developer, and may use a liquid developer. Further, a thermistor, that is disposed at the inner side of the fixing belt 122 and contacts the inner peripheral surface thereof, may be used instead of the non-contact-type temperature sensor 124 as the sensor for sensing the temperature of the fixing belt 122. Moreover, if conversion of the temperature is set in advance, the temperature sensor 124 may be provided at a position opposing the surface of the pressure roller 104.

The slits 109, 160 may be formed in an inclined direction, provided that they can cut-off eddy current. Further, the eddy current cutting-off structure is not limited to the slits 109, 160, and, for example, a resin material having low electric conductivity may be embedded in portions of the temperature-sensitive layers 103, 152.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating rotating body comprising:

a rotating body that generates heat due to electromagnetic induction in a magnetic field and whose magnetic permeability starts to decrease continuously from a magnetic permeability change start temperature that is in a temperature region that is greater than or equal to a set temperature and less than or equal to a heat-resistant temperature, and an eddy current cutting-off structure that is formed on the rotating body and cuts-off a portion of eddy current generated by the electromagnetic induction.

2. A heating rotating body comprising a temperature-sensitive layer that includes material which generates heat due to electromagnetic induction in a magnetic field and whose magnetic permeability starts to decrease continuously from a magnetic permeability change start temperature that is in a temperature region that is greater than or equal to a set temperature and less than or equal to a heat-resistant temperature, and is provided with openings formed therein that cut-off a portion of eddy current generated by the electromagnetic induction.

3. A heating device comprising:

the heating rotating body of claim 2; and a magnetic field generating unit that is disposed so as to face the heating rotating body, and generates a magnetic field.

4. A fixing device comprising:

the heating device of claim 3; and a fixing member that is disposed between the heating rotating body and a pressure-applying rotating body, the pressure-applying rotating body contacting the fixing member, and fixing a developer image on a recording medium passing between the pressure-applying rotating body and the fixing member, to the recording medium.

5. An image forming device comprising:

the fixing device of claim 4;

an exposure section that emits exposure light;

a developing section that visualizes a latent image, that is formed by the exposure light, by a developer so as to form a developer image;

a transfer section that transfers the developer image, that is visualized at the developing section, onto a recording medium; and a transporting section that transports the recording medium, onto which the developer image is transferred at the transfer section, to the fixing device.

6. A fixing device comprising:

the heating device of claim 3;

a tensioning rotating body that is disposed so as to be apart from the heating rotating body;

a fixing member that is trained around the heating rotating body and the tensioning rotating body; and a pressure-applying rotating body that contacts an outer peripheral surface of the fixing member, and applies pressure to the fixing member in a direction toward the tensioning rotating body, and fixes a developer image on a recording medium passing between the pressure-applying rotating body and the fixing member, to the recording medium.

7. The fixing device of claim 6, wherein the fixing member has a heat-generating layer of a thickness that is thinner than at least a skin depth, and a heat generation amount of the temperature-sensitive layer of the heating rotating body is smaller than that of the heat-generating layer.

8. The fixing device of claim 7, wherein the heat-generating layer includes a layer of a non-magnetic metal material whose thickness is 2 to 20 μm and whose specific resistance is less than or equal to $2.7\times10^{-8}$ Ωcm.

9. The heating rotating body of claim 2, wherein the openings are formed in a direction intersecting a direction of eddy current that flows at the rotating body.

10. A heating device comprising:

the heating rotating body of claim 2; and a magnetic field generating unit that is disposed within the heating rotating body, and generates a magnetic field.

11. The heating rotating body of claim 2, wherein the openings are arranged in rows in an axial direction of the heating rotating body, the rows including a first row and a second row that are staggered so as to be offset from each other.

12. The heating rotating body of claim 11, wherein the openings extend in a rotating direction of the heating rotating body, each end portion of the openings of the first row and the second row overlapping one another in an axial direction of the heating rotating body.

13. A heating rotating body comprising a rotating body including a temperature-sensitive layer that generates heat due to electromagnetic induction in a magnetic field and whose magnetic permeability decreases continuously from a predetermined temperature, wherein a plurality of cuts are formed in the temperature-sensitive layer in a direction cutting-off a portion of eddy current that is generated by the electromagnetic induction.

14. The heating rotating body of claim 13, wherein the cuts are formed in a direction intersecting a direction of eddy current that flows at the rotating body.

15. A heating device comprising:

the heating rotating body of claim 13; and a magnetic field generating unit that is disposed so as to face the heating rotating body, and generates a magnetic field.

16. A fixing device comprising:

the heating device of claim 15; and a fixing member that is disposed between the heating rotating body and a pressure-applying rotating body, the pressure-applying rotating body contacting the fixing member, and fixing a developer image formed on a recording medium passing between the pressure-applying rotating body and the fixing member, to the recording medium.

17. An image forming device comprising:

the fixing device of claim 16;

an exposure section that emits exposure light;

a developing section that visualizes a latent image, that is formed by the exposure light, by a developer so as to form a developer image;

a transfer section that transfers the developer image, that is visualized at the developing section, onto a recording medium; and a transporting section that transports the recording medium, onto which the developer image is transferred at the transfer section, to the fixing device.

18. A fixing device comprising:

the heating device of claim 15;

a tensioning rotating body that is disposed so as to be apart from the heating rotating body;

a fixing member that is trained around the heating rotating body and the tensioning rotating body; and a pressure-applying rotating body that contacts an outer peripheral surface of the fixing member, and applies pressure to the fixing member in a direction toward the tensioning rotating body, and fixes a developer image formed on a recording medium passing between the pressure-applying rotating body and the fixing member, to the recording medium.

19. The fixing device of claim 18, wherein the fixing member has a heat-generating layer of a thickness that is thinner than at least a skin depth, and the cuts are formed such that a heat generation amount of the temperature-sensitive layer of the heating rotating body is smaller than that of the heat-generating layer.

20. The fixing device of claim 19, wherein the heat-generating layer includes a layer of a non-magnetic metal material whose thickness is 2 to 20 μm and whose specific resistance is less than or equal to $2.7\times10^{-8}$ Ωcm.

21. The heating rotating body of claim 13, wherein the cuts are arranged in rows in an axial direction of the heating rotating body, the rows including a first row and a second row that are staggered so as to be offset from each other.

22. The heating rotating body of claim 21, wherein the cuts extend in a rotating direction of the heating rotating body, each end portion of the cuts of the first row and the second row overlapping one another in an axial direction of the heating rotating body.

* * * * *